US009879478B1

(12) United States Patent
Hall et al.

(10) Patent No.: US 9,879,478 B1
(45) Date of Patent: Jan. 30, 2018

(54) BLINDS WITH CONFORMABLE SEAL ON SLATS

(71) Applicants: David R. Hall, Provo, UT (US); Terrece Pearman, Draper, UT (US); Emily Brimhall, Alpine, UT (US)

(72) Inventors: David R. Hall, Provo, UT (US); Terrece Pearman, Draper, UT (US); Emily Brimhall, Alpine, UT (US)

( * ) Notice: Subject to any disclaimer, the term of this patent is extended or adjusted under 35 U.S.C. 154(b) by 0 days.

(21) Appl. No.: 15/426,673

(22) Filed: Feb. 7, 2017

(51) Int. Cl.
*E06B 9/386* (2006.01)

(52) U.S. Cl.
CPC ..... *E06B 9/386* (2013.01)

(58) Field of Classification Search
CPC ..... E06B 9/386; E06B 9/30; E06B 9/32
USPC ..... 160/236; 49/91.1
See application file for complete search history.

(56) References Cited

U.S. PATENT DOCUMENTS 126,713 A * 5/1872 Kelly ..... E06B 7/084 160/236
2,155,985 A * 4/1939 Waterman ..... E06B 9/305 160/176.1 R
2,528,332 A * 10/1950 Bergquist ..... A47L 9/1454 160/130
4,292,763 A * 10/1981 Barnes ..... E06B 9/28 160/236
4,327,795 A * 5/1982 Wheeler ..... E06B 3/28 126/629
4,934,437 A * 6/1990 Kraeutler ..... E06B 9/0669 160/264
5,320,155 A * 6/1994 Bressler ..... E06B 9/386 160/166.1
8,844,603 B1 * 9/2014 Anti ..... E06B 9/307 160/176.1 R
2016/0312529 A1 * 10/2016 Fonville ..... E06B 9/307

* cited by examiner

*Primary Examiner* — Blair M Johnson

(57) ABSTRACT

We disclose a window blind which includes at least one conformable seal which may inhibit light and/or heat transmission. The slats of the window blinds may include conformable seals on one or more of their edges. The conformable seals may include interlocking teeth, intermingled bristles, or a continuous strip of material which may form a lip. The window blinds may also include a conformable seal around an orifice through which a cord may be inserted. The conformable seal around the orifice may be designed similar to those of the slats or may include overlapping flaps of material. The slats may also include materials with different properties on either side of the slats. These may include light reflecting material and heat absorbing material.

20 Claims, 8 Drawing Sheets

BLINDS WITH CONFORMABLE SEAL ON SLATS

BACKGROUND

Field of the Invention

This disclosure relates to window blinds, specifically, window blinds which regulate the entry of light and heat through the window.

Background of the Invention

Window blinds are used to control light and heat transmission between the window and the adjacent room. The window blinds may include slats, either horizontal or vertical, which may be angled to allow a desired amount of sunlight through the window and into the room. When no light or heat transmission is desired, the slats may be angled so that they create a nearly continuous sheet between the window and the room.

Traditional blinds block much of the light and heat transmission between the window and the adjacent room. However, light is still visible passing through a window which is covered with a traditional blind, even with the slats in their fully closed position. The light may enter between the slats, below the slats, between the uppermost slat and the headrail, or along the lateral edges of the slat. Similarly, heat transmission may occur through the same routes.

It is desirable to control light transmission for various purposes which involve the comfort of individuals within the room. It is further desirable to control heat transmission for efficient temperature control of the room and energy usage. A window blind which more completely inhibits light and heat transmission between the window and the adjacent room through the slats of the blind is needed.

BRIEF SUMMARY OF THE INVENTION

We disclose a window blind that may inhibit light and heat transmission when closed. The window blind includes slats with two sides and at least one conformable seal. One side of the slats may be light reflecting and the other side may be heat absorbing. The conformable seal or seals on each slat may interact with an adjacent seal, slat, headrail, or side of the window frame and may serve to block the transmission of light and/or heat into a room. The conformable seals may be constructed of interlocking members, interlocking teeth, intermingled bristles, a continuous lip of material, or magnets.

In one embodiment, the slats may be oriented horizontally. Each horizontal slat may include a conformable seal on one or more of any combination of the four horizontal or vertical edges. In another embodiment, the slats may be oriented vertically. Each vertical slat may include a conformable seal on one or more of any combination of the four horizontal or vertical edges.

In some embodiments, the conformable seals may interact with a conformable seal on an adjacent edge of an adjacent slat. Together, the two adjacent conformable seals may create a more complete seal.

Some embodiments may include an orifice for a cord which includes a conformable orifice seal. The conformable orifice seal may be constructed from similar material as the previously mentioned conformable seals or from a different material.

The top edge of the slat or slats which are adjacent to a head rail that may be included in the window blind may have a different type of conformable seal than the conformable seals that are adjacent to other conformable seals. This design may be used because a conformable seal that is in contact with the headrail may not have an adjacent seal with which to interlock or intermingle. Consequently, the edges adjacent to the headrail and/or the edges adjacent to the window frame may be of a design that does not require interlocking or intermingling of adjacent seals to form the seal.

DETAILED DESCRIPTION OF THE INVENTION

Definitions

Figure 1:
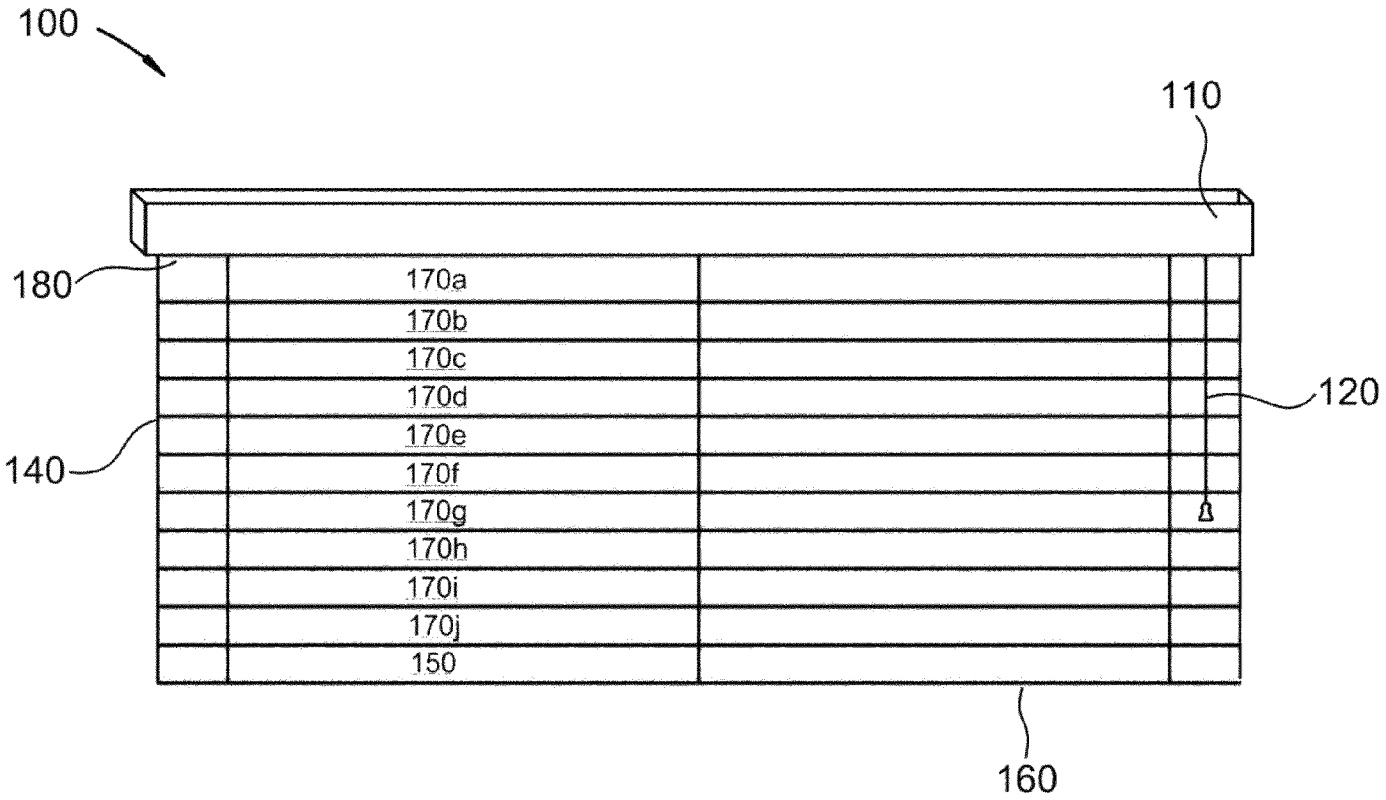
FIG. 1 illustrates an embodiment of a window blind according to the disclosure in which horizontal slats include conformable seals between them.

Window blind, as used herein, means a blind that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a window blind which may, when closed, block transmission of light and heat. An embodiment of a horizontal window blind may comprise a headrail, a plurality of slats, and a final slat. Each of the plurality of slats may have a conformable seal on one or more of the two vertical sides, one or more of the two horizontal sides, or a combination thereof. In some embodiments, the conformable seals on adjacent edges of adjacent slats intermingle or interlock to form a tighter seal than either would accomplish alone.

The conformable seals may be comprised of, but are not limited to, interlocking members, interlocking teeth, intermingled bristles, or magnets.

In some embodiments, the slat that is adjacent to the headrail may include a conformable seal on the horizontal edge nearest the headrail which is of a different design than the conformable seals on the slats that are between to two other slats. This may be desirable in embodiments in which the edges of slats that are adjacent to edges of adjacent slats include interlocking or intermingling conformable seals. In contrast, the horizontal edge of the slat that is adjacent to the headrail may not be adjacent to another conformable seal with which to interlock. Therefore, the conformable seal in this position may not be designed to complete the seal by interlocking with an adjacent compliant seal.

The final slat may include an end seal, wherein the end seal is connected to the lower horizontal edge of the final slat. The end seal may inhibit the transfer of light and heat between the final slat and a window frame. As with the slat adjacent to the headrail, the lower horizontal edge of the end slat may be of a different design than the other compliant seals, possibly because there is no adjacent compliant seal with which to interlock to complete the seal.

In another embodiment of the invention, the window blind may be a vertical blind with multiple slats. The slats may have one or more compliant seals on all or some of the two horizontal edges and the two vertical edges.

The conformable seal may be constructed from one or more of the following materials: rubber, plastic, synthetic fabric, cotton fabric, hair, leather, felt, and polymeric foam. In addition, the conformable seal may comprise a light reflective material on its outer side. The light reflecting material may include, but is not limited to, one or more of the following: aluminum, Mylar, chrome, silver, nickel, copper, or reflective paint. The conformable seal may also have an inner side that includes a heat absorbing material.

Some embodiments may include an orifice for inserting a cord which may comprise a conformable orifice seal. The conformable orifice seal may include light reflective material, heat absorbing material, or both which inhibit the transfer of light and/or heat through the orifice. The conformable orifice seal may comprise either intermingled bristles or overlapping flaps.

In any of the described embodiments, or in other embodiments of the invention, the first side of the plurality of slats may include a light reflective material. This light reflective material may include, but is not limited to, one or more of the following materials: aluminum, Mylar, chrome, silver, nickel, copper, and reflective paint. The second side of the plurality of slats in any embodiment of the invention may comprise a heat absorbing material.

Referring now to the drawings, FIG. 1 shows horizontal blind 100, which is an embodiment of the current disclosure. Horizontal blind 100 includes headrail 110, cord 120, and slats 170*a*-170*j*. Note that slat 170*a* is connected to headrail 110 and includes conformable seal 180 on its upper horizontal edge. In some embodiments, conformable seal 180 may be a different design from conformable seal 140 on the upper and lower horizontal edges of the slats that are between adjacent slats. The design of conformable seal 180 may differ from that of conformable seal 140 because conformable seal 140 may include interlocking pieces, one from one slat and one from an adjacent slat. In contrast, conformable seal 180 does not abut an adjacent conformable seal. Final slat 150 is shown as the lowest slat in the window blind. Final slat 150 includes end seal 160 which may also be a different design from conformable seal 140 on the upper and lower horizontal edges of the slats that are between adjacent slats for the same reasons as described with regard to conformable seal 180.

Figure 2A:
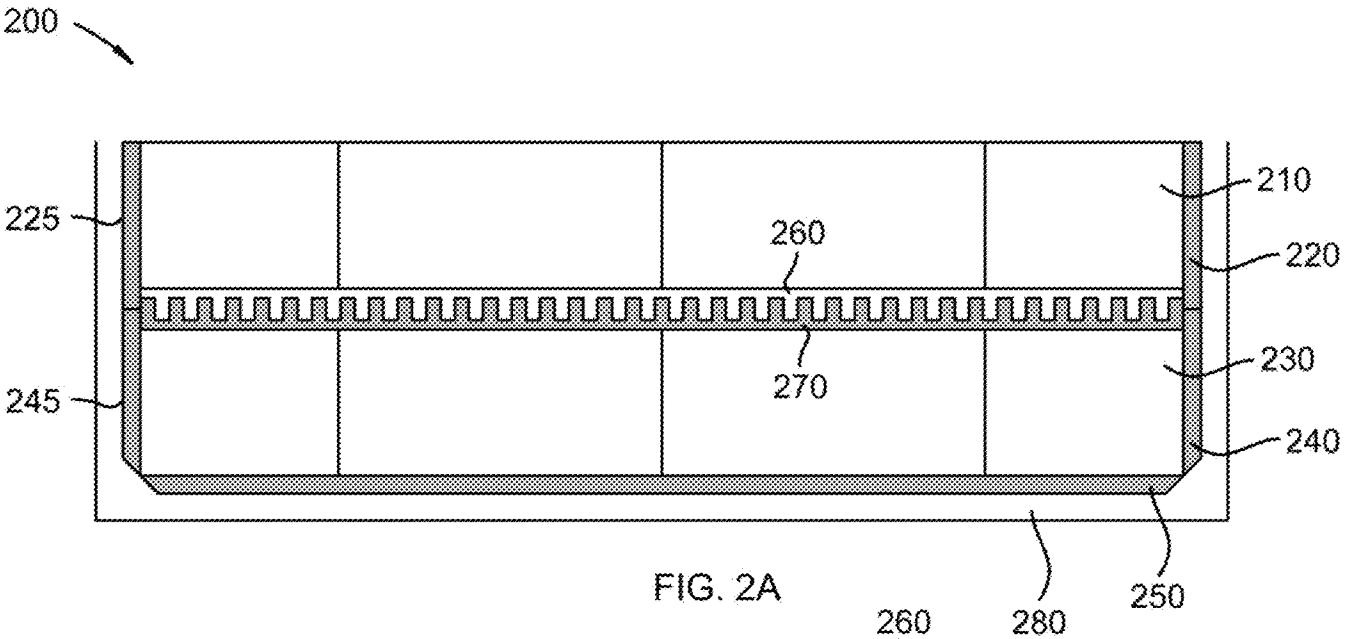
FIG. 2A illustrates two slats from a window blind according to the disclosure in which the conformable seals on adjacent slats include interlocking teeth.

FIG. 2A shows embodiment 200 of the disclosed window blinds. More specifically, embodiment 200 illustrates the lower two slats, slat 210 and final slat 230 of an embodiment of a window blind according to the disclosure. Final slat 230 is the lowest slat in the window blind. Embodiment 200 is shown within window frame 280. Slat 210 includes conformable seals 220 and 225 on the two vertical edges of slat 210. Likewise, final slat 230 includes conformable seals 240 and 245 on the two vertical edges of final slat 230. Conformable seals 220, 225, 240, and 245 may seal the vertical edges of slat 210 and final slat 230 from light and heat transmission through spaces that would exist between the slats of traditional blinds and the window frame. Final slat 230 also includes end seal 250. End seal 250 contacts window frame 280 when the window blind is fully lowered. End seal 250 may inhibit light and heat transmission between a space that would exist between a traditional blind and the window frame.

Slat 210 and final slat 230 include conformable seals 260 (shown in white) and 270 (shown shaded) respectively. Each of conformable seals 260 and 270 include teeth which interlock. The interlocking teeth are shown in more detail in FIG. 2B.

In contrast, conformable seals 220, 225, 240, and 245 and end seal 250 are not positioned adjacent to another conformable seal. Therefore, they do not include interlocking teeth. Rather, they are shown as a continuous strip which may be a bendable lip which may bend to form a seal upon coming in contact with window frame 280.

Figure 2B:
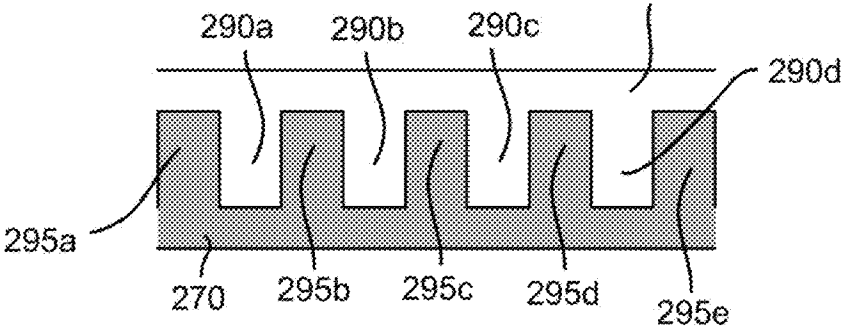
FIG. 2B illustrates a close-up view of the conformable seals of FIG. 2A which include interlocking teeth.

FIG. 2B is a close-up view of conformable seals 260 and 270 from FIG. 2A. Teeth 290*a*, 290*b*, 290*c*, and 290*d* are shown in white and are part of conformable seal 260. Teeth 295*a*, 295*b*, 295*c*, 295*d*, and 295*e* are part of conformable seal 270 shown shaded. Teeth 290*a-d* interlock with teeth 295*a-e*.

Figure 3A:
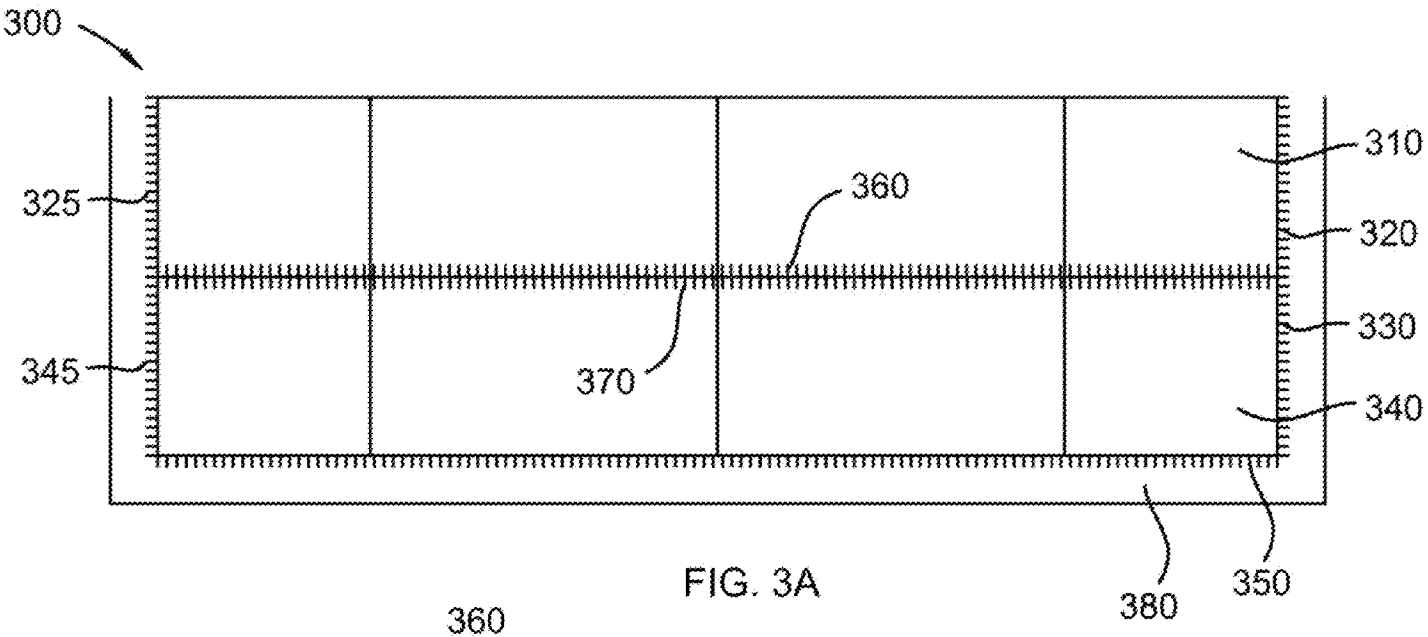
FIG. 3A illustrates two slats from a window blind according to the disclosure in which the conformable seals on adjacent slats include intermingled bristles.

FIG. 3A shows embodiment 300 of the disclosed window blinds. More specifically, embodiment 300 illustrates the lower two slats, slat 310 and final slat 340 of an embodiment of a window blind according to the disclosure. Final slat 340 is the lowest slat in the window blind. Embodiment 300 is shown within window frame 380. Slat 310 includes conformable seals 320 and 325 on the two vertical edges of slat 310. Likewise, final slat 340 includes conformable seals 340 and 345 on the two vertical edges of final slat 340. Conformable seals 320, 325, 340, and 345 may seal the vertical edges of slat 310 and final slat 340 from light and heat transmission through spaces that would exist between the slats of traditional blinds and window frame 380. Final slat 340 also includes end seal 350. End seal 350 contacts window frame 380 when the window blind is fully lowered. End seal 350 may inhibit light and heat transmission between a space that would exist between a traditional blind and window frame 380.

Slat 310 and final slat 340 include conformable seals 360 and 370 which are intermingled bristles. The bristles coming from one direction fill in gaps left by bristles coming from the other direction. The intermingled bristles are shown in more detail in FIG. 3B.

In contrast, conformable seals 320, 325, 330, and 345 and end seal 350 are not positioned adjacent to another conformable seal with bristles. Therefore, they do not include intermingled bristles. In some embodiments, conformable seals 320, 325, 330, and 345 and end seal 350 may include more bristles per inch of edge to provide a more thorough seal.

Figure 3B:
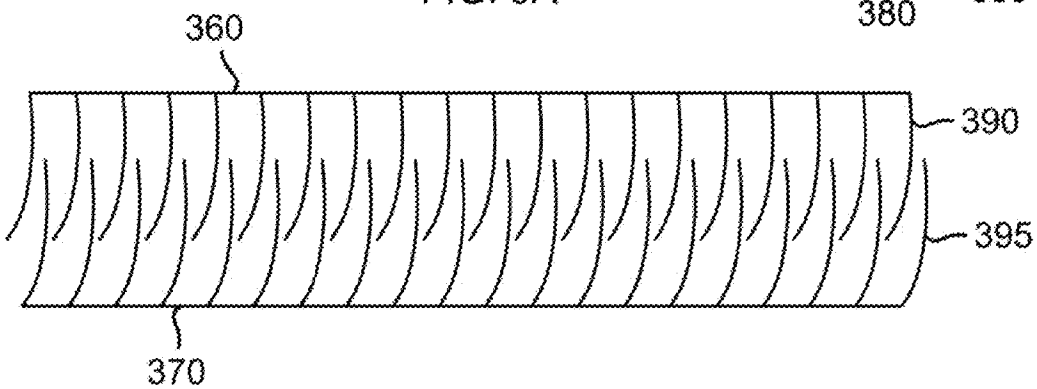
FIG. 3B illustrates a close-up view of the conformable seals of FIG. 3A which include intermingled bristles.

FIG. 3B. is a close-up view of conformable seals 360 and 370 from FIG. 3A. Bristle 390 extends from conformable seal 360 while bristle 395 extends from conformable seal 370. Bristles 390 and 395 intermingle from opposite directions filling up gaps between bristles of the opposite conformational seal. Other bristles are not labeled for clarity.

Figure 4:
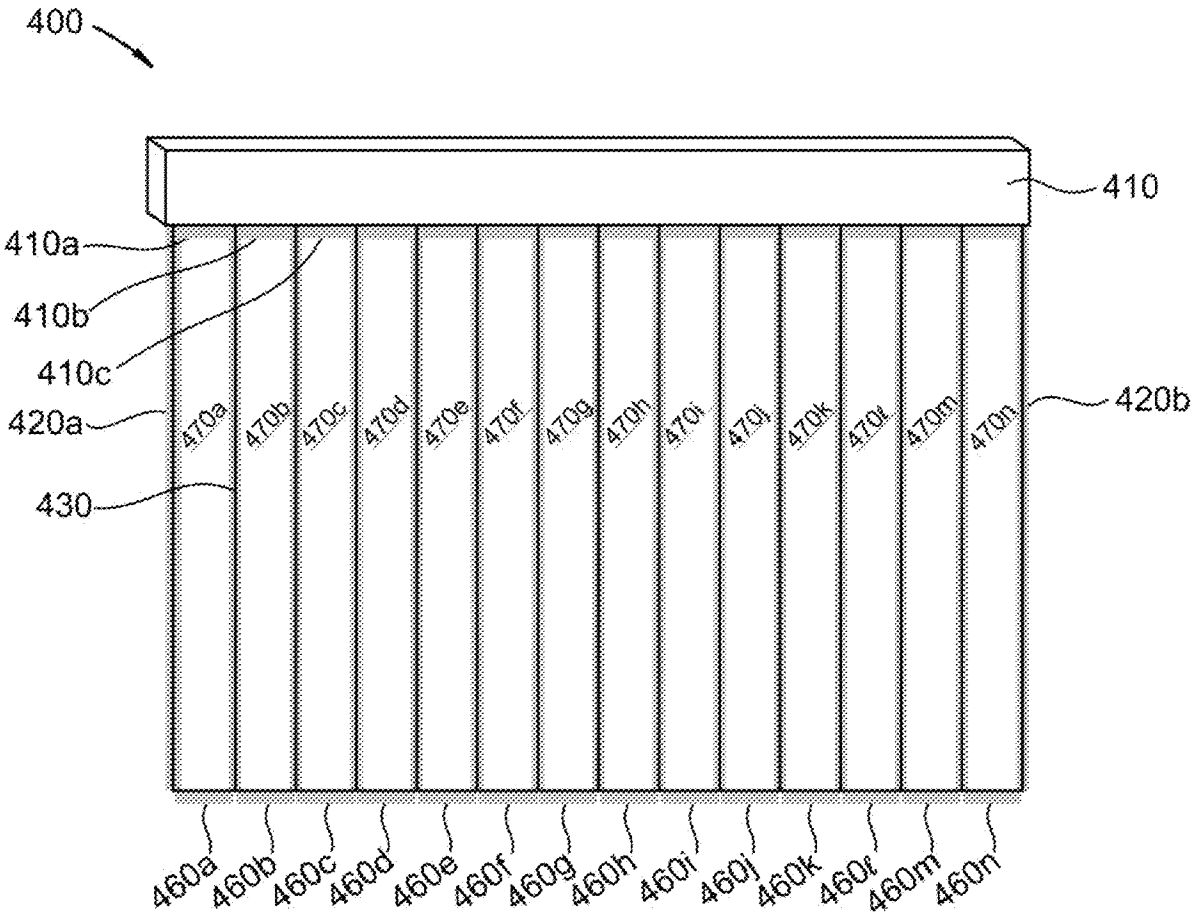
FIG. 4 illustrates an embodiment of a window blind according to the disclosure in which vertical slats include conformable seals between them.

FIG. 4 shows vertical blind 400, which is an embodiment of the current disclosure. Vertical blind 400 includes headrail 410 which is connected to slats 470*a*-470*n*. Each of slats 470*a*-470*n* include a conformable seal on its upper vertical edge which may inhibit light and heat transmission through a space that would exist above the slats of traditional blinds. Examples are conformable seals 410*a*, 410*b*, and 410*c* which are connected to slats 470*a*, 470*b*, and 470*c* respectively. Conformable seals on the upper vertical edges of slats 470*d*-470*n* are not labeled for clarity. The lower vertical edges of slats 470*a*-470*m* are illustrated as conformable seals 460*a*-460*n* respectively. Conformable seals 460*a*-460*n* may inhibit light and heat transmission through a space that would exist below the slats of traditional blinds.

Similar to horizontal blind 100 of FIG. 1, slats 470*a*-470*n* include conformable seals between adjacent slats. These include conformable seal 430 shown between slats 470*a* and 470*b*. For clarity, other conformable seals between slats are not labeled. These conformable seals between slats may include interlocking teeth as shown in FIG. 2B, intermingled bristles as shown in FIG. 3B, or other embodiments disclosed herein.

Slats 470*a* and 470*n* are each on an end of vertical blind 400. Accordingly, each of slats 470*a* and 470*n* have an adjacent slat on only one side. Therefore, conformable seals 420*a* and 420*b* on slats 470*a* and 470*n* respectively may be a different design than conformable seal 430 at least because there is no adjacent conformable seal to form interlocking teeth or intermingled bristles. In some embodiments, conformable seals 420*a* and 420*b* may include a single continuous lip or a series of bristles with more bristles per inch of edge than the conformable seals with intermingled bristles.

Figure 5:
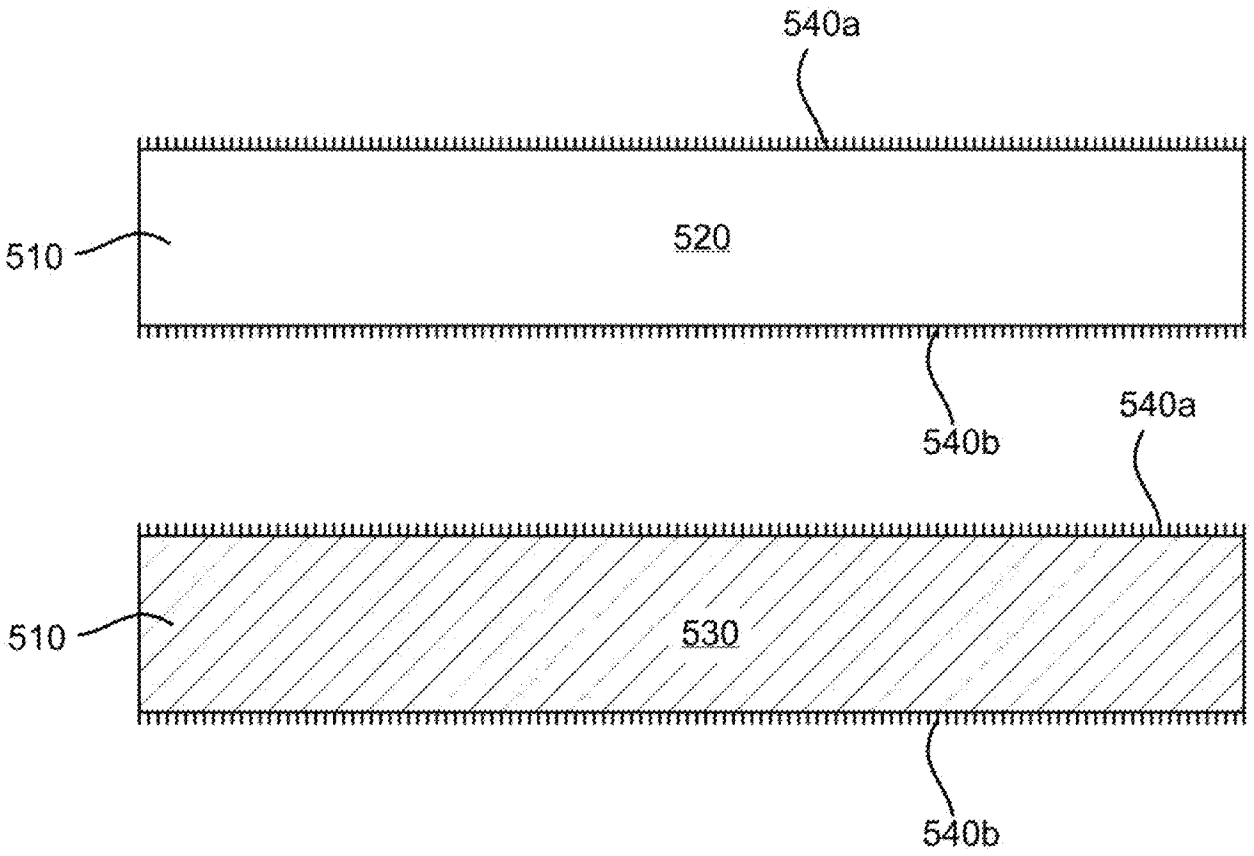
FIG. 5 illustrates two sides of a slat from a window blind according to the disclosure in which one side includes light reflective material and the other side includes heat absorbing material.

FIG. 5 illustrates slat 510 which may be within a window blind according to the disclosure. Slat 510 includes two sides, side 520 and 530. Each side includes a different material. Side 520 includes a light reflective material. Accordingly, side 520 may be placed nearest the outside of the building to reflect sunlight. Side 530 includes a heat absorbing material. Accordingly, side 530 may be placed facing the adjacent room to absorb heat during warm weather. Slat 510 also includes conformable seals 540*a* and 540*b* along its horizontal edges. In this embodiment, conformable seals 540*a* and 540*b* are bristles which may intermingle with bristles on adjacent slats.

Figure 6A:
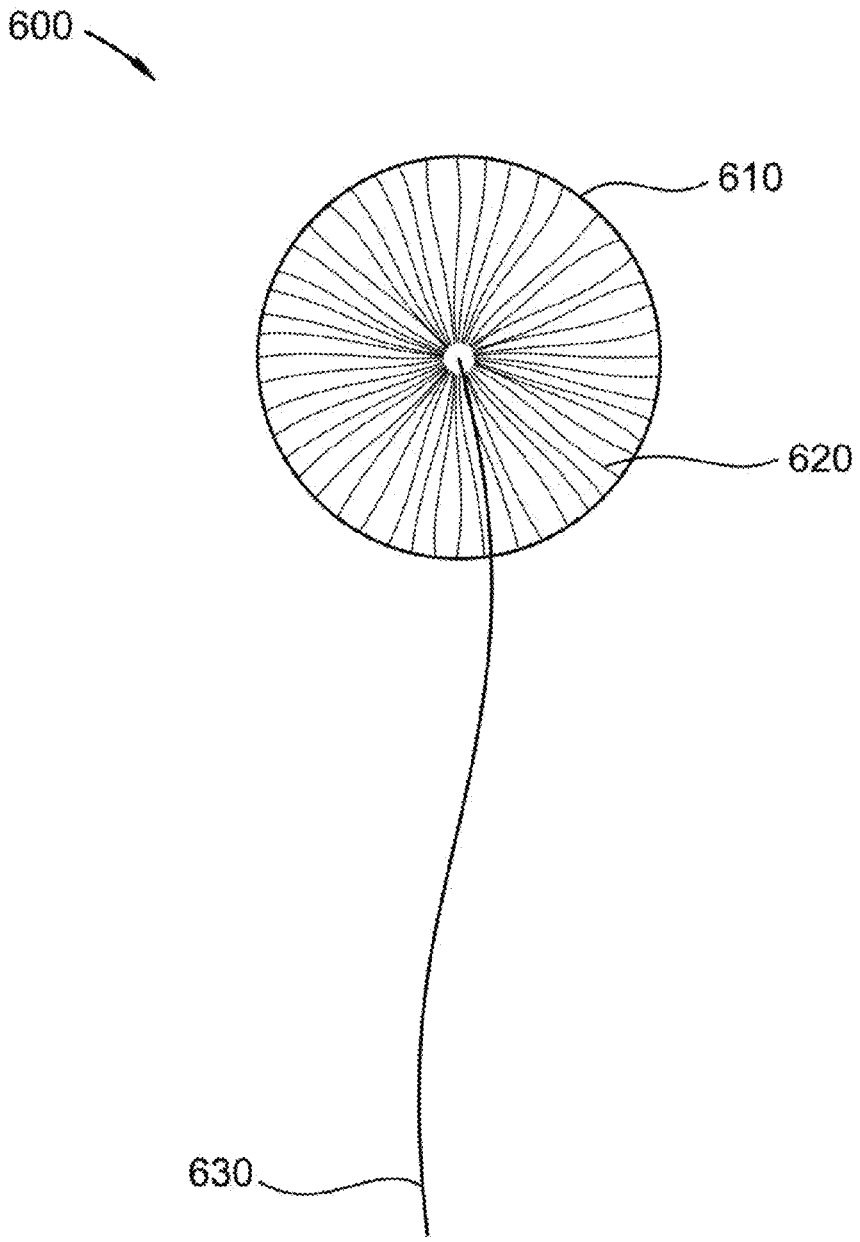
FIG. 6A illustrates an orifice for inserting a cord including a conformable orifice seal which includes intermingled bristles.

FIG. 6A illustrates cord system 600 which includes cord 630. Orifice 610 is an opening through which cord 630 travels. Orifice 610 includes compliant seal 620 which, in this embodiment, includes intermingled bristles.

Figure 6B:
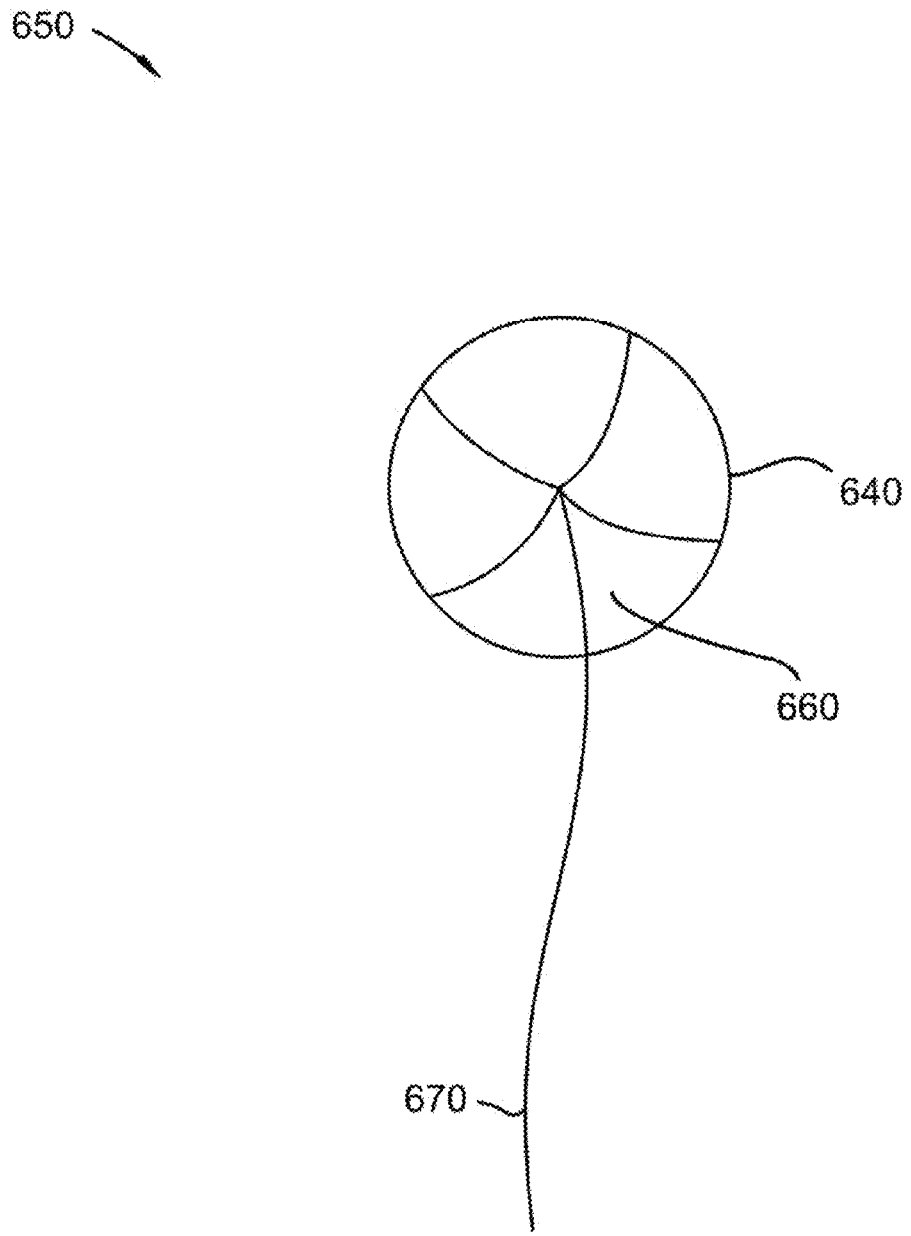
FIG. 6B illustrates an orifice for inserting a cord including a conformable orifice seal which includes overlapping flaps.

FIG. 6B illustrates cord system 650 which includes cord 670. Orifice 640 is an opening through which cord 670 travels. Orifice 640 includes compliant seal 660 which, in this embodiment, includes overlapping flaps.

Figure 7:
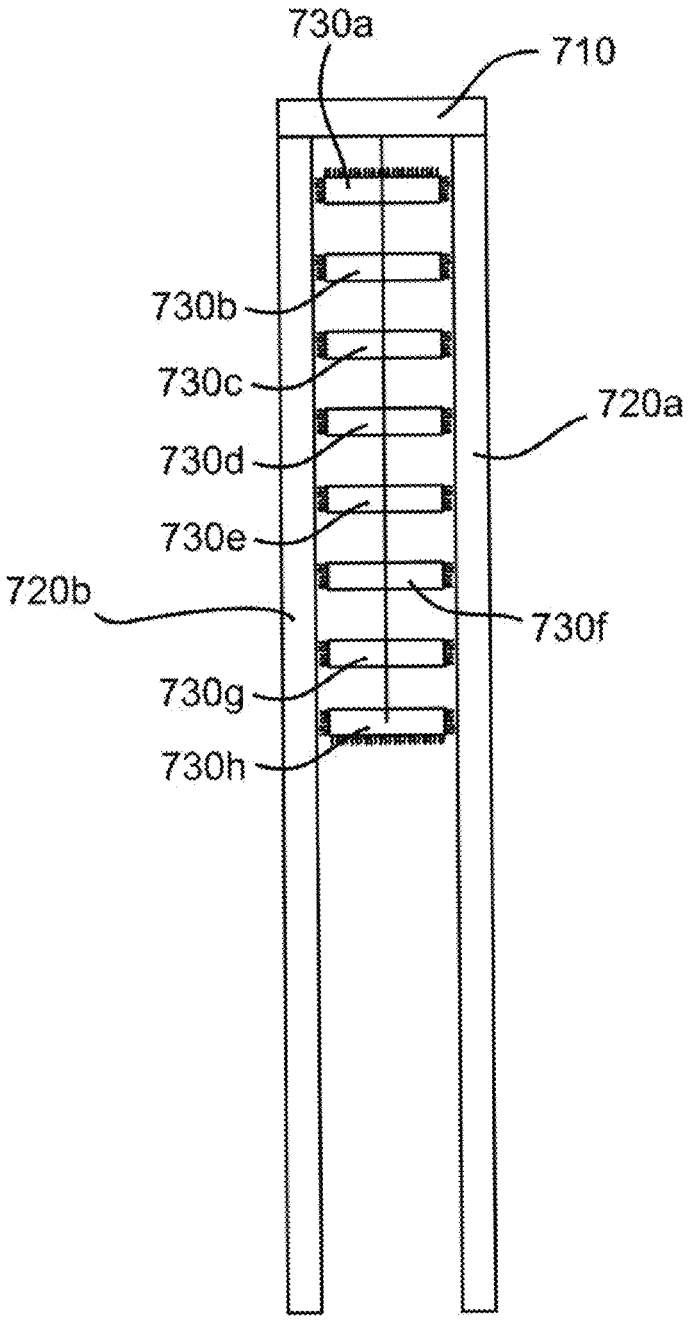
FIG. 7 illustrates window blind according to the disclosure in which the blind is positioned between two glass window panes.

FIG. 7 shows a side view of a horizontal blind which is hung between two window panes, panes 720*a* and 720*b*. The window blind includes headrail 710 to which slats 730*a*-730*h* are hung. Each of slats 730*a*-730*h* includes bristles which create conformable seals and which are not labeled for clarity.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A window blind comprising:

a headrail;

a plurality of horizontal slats, or a plurality of vertical slats, wherein each of the plurality of slats are in connection with either one or two adjacent slats, wherein at least one of the plurality of slats is in connection with the headrail, and wherein each of the plurality of slats comprises:

a first side;

a second side;

two horizontal edges, wherein the two horizontal edges comprise an upper horizontal edge and a lower horizontal edge;

two vertical edges; and at least one conformable seal, wherein the at least one conformable seal is positioned along one or more of the horizontal and vertical edges of each of the plurality of slats, wherein the at least one conformable seal is in connection with the one or more of the horizontal and vertical edges of an adjacent slat, and wherein the at least one conformable seal inhibits the transfer of light and heat, and the plurality of horizontal slats each comprises one or more orifices, the orifices comprising a conformable seal comprising intermingled bristles or overlapping flaps.

2. The window blind of claim 1, wherein the window blind comprises a horizontal blind, wherein the at least one conformable seal comprises two conformable seals, and wherein the two conformable seals are positioned on the two horizontal edges of each of the plurality of slats.

3. The window blind of claim 2, wherein the two conformable seals are on slats that are positioned between two other slats comprise interlocking members.

4. The window blind of claim 3, wherein the interlocking members comprise interlocking teeth.

5. The window blind of claim 3, wherein the interlocking members comprise intermingled bristles.

6. The window blind of claim 3, wherein the interlocking members comprise magnets.

7. The window blind of claim 2, comprising a final slat, wherein the final slat is the lowest of the plurality of slats when the window blind is fully lowered, and wherein the final slat comprises:

a first side;

a second side;

an upper horizontal edge, wherein the upper horizontal edge is in contact with an adjacent slat;

a lower horizontal edge, wherein the lower horizontal edge defines the lower edge of the window blind;

two vertical edges; and wherein the final slat includes an end seal, wherein the end seal is in connection with the lower horizontal edge of the final slat, and wherein the end seal inhibits the transfer of light and heat between the final slat and a window frame when the end seal and the window frame are in contact.

8. The window blind of claim 1, wherein the vertical blind comprises two conformable seals, and wherein the two conformable seals are positioned on the two vertical edges of each of the plurality of slats.

9. The window blind of claim 8, wherein each of the plurality of slats further comprises a conformable seal on the lower horizontal edge.

10. The window blind of claim 1, wherein the conformable seal comprises one or more of the following: rubber, plastic, synthetic fabric, cotton fabric, hair, leather, felt, and polymeric foam.

11. The window blind of claim 1, wherein the conformable seal comprises an outer side, wherein the outer side comprises a light reflective material.

12. The window blind of claim 1, wherein the light reflecting material comprises one or more of the following: aluminum, Mylar, chrome, silver, nickel, copper, and reflective paint.

13. The window blind of claim 1, wherein the conformable seal comprises an inner side, wherein the inner side comprises a heat absorbing material.

14. The window blind of claim 1, wherein the two horizontal edges and the two vertical edges of each of the plurality of slats comprises a conformable seal.

15. The window blind of claim 1, further comprising an orifice for inserting a cord wherein the orifice conformable seal comprises a conformable orifice seal, wherein the conformable orifice seal inhibits the transfer of light and heat through the orifice.

16. The window blind of claim 1, wherein the conformable orifice seal comprising either intermingled bristles or overlapping flaps comprises a light reflecting material.

17. The window blind of claim 1, wherein the first side of the plurality of slats comprises a light reflecting material.

18. The window blind of claim 17, wherein the light reflecting material comprises one or more of the following: aluminum, Mylar, chrome, silver, nickel, copper, and reflective paint.

19. The window blind of claim 17, wherein the second side of the plurality of slats comprises a heat absorbing material.

20. The window blind of claim 1, wherein the second side of the plurality of slats comprises a heat absorbing material.

* * * * *